US009911520B2

(12) United States Patent
Hallinan, Jr. et al.

(10) Patent No.: US 9,911,520 B2
(45) Date of Patent: Mar. 6, 2018

(54) ALKYLAMINE-GOLD NANOPARTICLES HAVING TUNABLE ELECTRICAL AND OPTICAL PROPERTIES

(71) Applicant: FLORIDA STATE UNIVERSITY RESEARCH FOUNDTION, INC., Tallahassee, FL (US)

(72) Inventors: Daniel Hallinan, Jr., Tallahassee, FL (US); Guang Yang, Tallahassee, FL (US)

(73) Assignee: FLORIDA STATE UNIVERSITY RESEARCH FOUNDATION, INC., Tallahasse, FL (US)

( * ) Notice: Subject to any disclaimer, the term of this patent is extended or adjusted under 35 U.S.C. 154(b) by 0 days.

(21) Appl. No.: 15/297,822

(22) Filed: Oct. 19, 2016

(65) Prior Publication Data

US 2017/0129975 A1 May 11, 2017

Related U.S. Application Data

(60) Provisional application No. 62/252,944, filed on Nov. 9, 2015.

(51) Int. Cl.
*H01B 1/22* (2006.01)

(52) U.S. Cl.
CPC ..... *H01B 1/22* (2013.01)

(58) Field of Classification Search
None
See application file for complete search history.

(56) References Cited

U.S. PATENT DOCUMENTS 7,794,600 B1 * 9/2010 Buretea ..... B01D 15/08 210/635
2003/0029274 A1 * 2/2003 Natan ..... B01J 13/0043 75/741
2006/0178260 A1 * 8/2006 Zhong ..... B22F 9/24 502/185
2010/0328410 A1 * 12/2010 Grzybowski ..... C09D 11/02 347/100

OTHER PUBLICATIONS

Briglin, Langmuir, 2004, 20, 299-305 (Year: 2004).*
Ni, Journal of Physical Chemistry C, 2012, 116, 8095-8101 (Year: 2012).*
Olmos-Asar, Phys. Chem. Chem. Phys., 2014, 16, 15979-15987 (Year: 2014).*
Park, Chem. Mater. 2008, 20, 2388-2393 (Year: 2008).*
Chen, Chi-Fan et al., "Tunable Plasmonic Response from Alkanethiolate-Stabilized Gold Nanoparticle Superlattices: Evidence of Near-Field Coupling," JACS, 2008, 130, 824-826.
Daniel, M-C et al., "Gold Nanopartticles: Assembly, Supramolecular Chemistry, Quantum-Size-Related Properties, and Applications toward Biology, Catalysis and Nanotechnology," Chem. Rev, 2004, 104, 293-346.

(Continued)

*Primary Examiner* — Robert C Boyle
(74) *Attorney, Agent, or Firm* — FisherBroyles, LLP; Richard S. Echler; Anthony J. DoVale

(57) ABSTRACT

Disclosed herein are monolayers comprising alkylamine-gold nanoparticles that have tunable electrical and optical properties. Also disclosed is a method for forming the monolayers that comprises self-assembly of the nanoparticles.

20 Claims, 16 Drawing Sheets

(56) References Cited

OTHER PUBLICATIONS

Ung T et al., "Optical Propeties of Thin Films of Au@SiO2 Particles," J. Phys. Chem. B, 2001, 105, 3441-3452.
Yang G et al., "Gold Nanoparticle Monolayers with Tunable Optical and Electrical Properties," Langmuir, 2016, 32, 4022-4033.
Yang G et al., "Self-assembly of large-scale crack-free gold nanoparticle films using a "drain-to-deposit" strategy," Nanotechnology, 27 (2016).
Yang G. et al., "Gold Nanoparticle Monolayers from Sequential Interfacial Ligand Exchange and Migration in a Three-Phase System," Scientific Reports, 6, 35339 (2016).

* cited by examiner

ALKYLAMINE-GOLD NANOPARTICLES HAVING TUNABLE ELECTRICAL AND OPTICAL PROPERTIES

CROSS REFERENCE TO RELATED APPLICATIONS

This application claims the benefit of Provisional Application Ser. No. 62/252,944, filed on Nov. 9, 2015, the entire disclosure of which is incorporated herein by reference in its entirety.

FIELD OF THE DISCLOSURE

Disclosed herein are monolayers comprising alkylamine-gold nanoparticles that have tunable electrical and optical properties. Also disclosed is a method for forming the monolayers that comprises self-assembly of the nanoparticles.

BRIEF DESCRIPTION OF THE FIGURES

FIG. 2A is a SEM image of an IDE while FIG. 2B is a schematic of the IDE geometry.

FIG. 4A is hexylamine, FIG. 4B is nonylamine, FIG. 4C is dodecylamine, FIG. 4D is pentadecylamine and FIG. 4E is octadecylamine.

FIG. 19A is a monolayer wherein the ligand is $C_{12}$ linear alkyl amine, FIG. 19B is a monolayer wherein the ligand is $C_{15}$ linear alkyl amine, FIG. 19C is a monolayer wherein the ligand is $C_{18}$ linear alkyl amine, FIG. 19D is a monolayer wherein the ligand is oleyl alkyl amine, and FIG. 19E is a monolayer wherein the ligand is a polystyrene amine (5000 g/mol). The scale bar is 100 nm and the insert scale bar is 20 nm.

FIG. 22A shows the effect of octadecylamine as the ligand. FIG. 22B shows the effect of oleyolyamine as the ligand. FIG. 22C shows the effect of a polystyreneamine as the ligand.

DETAILED DESCRIPTION

Figure 1:
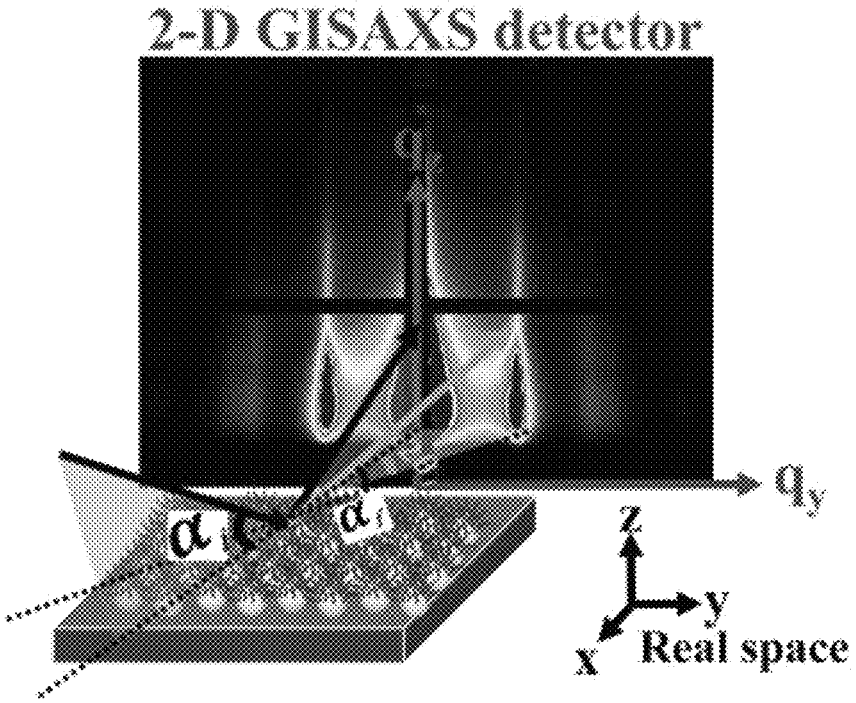
FIG. 1 is a schematic illustration of the experimental GISAXS setup used to evaluate the disclosed alkylamine-gold nanoparticle monolayers.

The materials, compounds, compositions, articles, and methods described herein may be understood more readily by reference to the following detailed description of specific aspects of the disclosed subject matter and the Examples included therein.

Before the present materials, compounds, compositions, and methods are disclosed and described, it is to be understood that the aspects described below are not limited to specific synthetic methods or specific reagents, as such may, of course, vary. It is also to be understood that the terminology used herein is for the purpose of describing particular aspects only and is not intended to be limiting.

All percentages, ratios and proportions herein are by weight, unless otherwise specified. All temperatures are in degrees Celsius (° C.) unless otherwise specified.

In this specification and in the claims that follow, reference will be made to a number of terms that shall be defined to have the following meanings:

Throughout this specification, unless the context requires otherwise, the word "comprise," or variations such as "comprises" or "comprising," will be understood to imply the inclusion of a stated integer or step or group of integers or steps but not the exclusion of any other integer or step or group of integers or steps.

It must be noted that, as used in the specification and the appended claims, the singular forms "a," "an" and "the" include plural referents unless the context clearly dictates otherwise. Thus, for example, reference to "a nanoparticle" includes mixtures of two or more such carriers, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed, then "less than or equal to" the value, "greater than or equal to the value," and possible ranges between values are also disclosed, as appropriately understood by the skilled artisan. For example, if the value "10" is disclosed, then "less than or equal to 10" as well as "greater than or equal to 10" is also disclosed. It is also understood that throughout the application data are provided in a number of different formats and that this data represent endpoints and starting points and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

The term "modified nanoparticle" or "functionalized nanoparticle" or "capped nanoparticle" refers to disclosed gold nanoparticles which surfaces are modified with a molecular layer of one or more alkylamines, which includes polymeric amines, for example, polystyreneamine.

Figure 9:
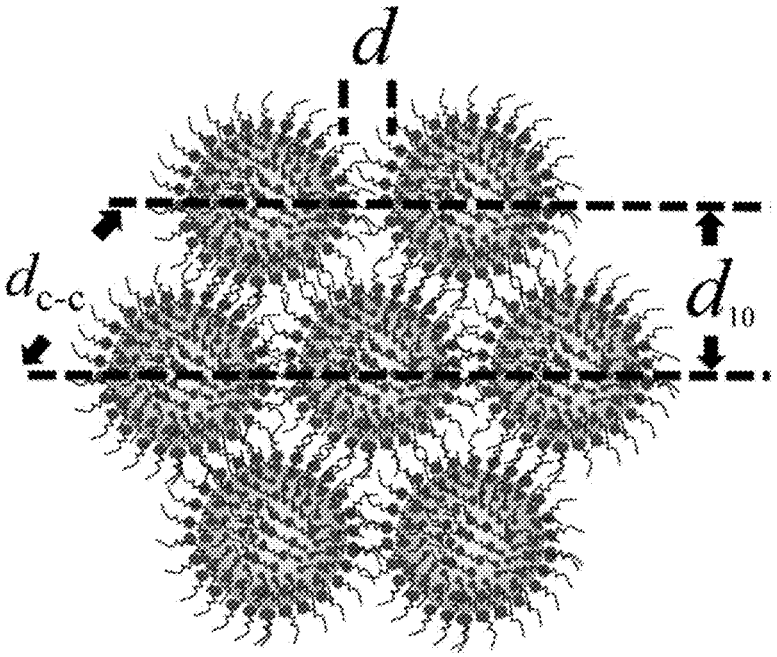
FIG. 9 is a schematic illustration of the geometric relationship among the (10) plane distance, $d_{10}$, the alkylamine-gold nanoparticle monolayer interparticle spacing, $d_{c\text{-}c}$, and the interparticle gap, d.

The term "interparticle spacing" and "interparticle gap" are defined as average distance from the center of the nanoparticle to the closest neighboring nanoparticles and the average distance from the gold nanoparticle surface to the surface of each neighboring particle respectively. These terms are exemplified in FIG. 9 and the description thereof.

Disclosed herein are alkylamine capped gold nanoparticle monolayers having tunable optical and electrical properties. The monolayers have long-range ordering thereby providing a homogeneous layer having uniform spacing.

The disclosed gold nanoparticles can have an average diameter of from about 1 nm to about 100 nm. For example, about 1 nm, about 2 nm, about 3 nm, about 4 nm, about 5 nm, about 6 nm, about 7 nm, about 8 nm, about 9 nm, about 10 nm, about 11 nm, about 12 nm, about 13 nm, about 14 nm, about 15 nm, about 16 nm, about 17 nm, about 18 nm, about 19 nm, about 20 nm, about 21 nm, about 22 nm, about 23 nm, about 24 nm, about 25 nm, about 26 nm, about 27 nm, about 28 nm, about 29 nm, about 30 nm, about 31 nm, about 32 nm, about 33 nm, about 34 nm, about 35 nm, about 36 nm, about 37 nm, about 38 nm, about 39 nm, about 40 nm, about 41 nm, about 42 nm, about 43 nm, about 44 nm, about 45 nm, about 46 nm, about 47 nm, about 48 nm, about 49 nm, about 50 nm, about 51 nm, about 52 nm, about 53 nm, about 54 nm, about 55 nm, about 56 nm, about 57 nm, about 58 nm, about 59 nm, about 60 nm, about 61 nm, about 62 nm, about 63 nm, about 64 nm, about 65 nm, about 66 nm, about 67 nm, about 68 nm, about 69 nm, about 70 nm, about 71 nm, about 72 nm, about 73 nm, about 74 nm, about 75 nm, about 76 nm, about 77 nm, about 78 nm, about 79 nm, about 80 nm, about 81 nm, about 82 nm, about 83 nm, about 84 nm, about 85 nm, about 86 nm, about 87 nm, about 88 nm, about 89 nm, about 90 nm, about 91 nm, about 92 nm, about 93 nm, about 94 nm, about 95 nm, about 96 nm, about 97 nm, about 98 nm, about 99 nm, and about 100 nm.

In one aspect the monolayers comprise alkylamine-gold nanoparticles having an interparticle spacing from about 0.5 nm to about 5 nm. The disclosed monolayers can have an average interparticle spacing of from about 1 nm to about 5 nm. In another embodiment, the monolayer can have an average interparticle spacing of from about 0.5 nm to about 4 nm. In a further embodiment, the monolayer can have an average interparticle spacing of from about 1 nm to about 3 nm. In another further embodiment, the monolayer can have an average interparticle spacing of from about 1.5 nm to about 2.5 nm. In a still another embodiment, the monolayer can have an average interparticle spacing of from about 2 nm to about 3 nm. The disclosed monolayers can have any interparticle spacing from about 0.5 nm to about 5 nm, for example, about 0.5 nm, about 0.6 nm, about 0.7 nm, about 0.8 nm, about 0.9 nm, about 1 nm, about 1.1 nm, about 1.2 nm, about 1.3 nm, about 1.4 nm, about 1.5 nm, about 1.6 nm, about 1.7 nm, about 1.8 nm, about 1.9 nm, about 2 nm, about 2.1 nm, about 2.2 nm, about 2.3 nm, about 2.4 nm, about 2.5 nm, about 2.6 nm, about 2.7 nm, about 2.8 nm, about 2.9 nm, about 3 nm, about 3.1 nm, about 3.2 nm, about 3.3 nm, about 3.4 nm, about 3.5 nm, about 3.6 nm, about 3.7 nm, about 3.8 nm, about 3.9 nm, about 4 nm, about 4.1 nm, about 4.2 nm, about 4.3 nm, about 4.4 nm, about 4.5 nm, about 4.6 nm, about 4.7 nm, about 4.8 nm, about 4.9 nm and about 5 nm.

In one aspect the alkylamine is chosen from $C_4$-$C_{22}$ linear or branched, saturated or unsaturated alkylamines. In one embodiment the alkylamine is a $C_6$-$C_{18}$ linear alkylamine. The alkylamine can be any alkylamine having from 4 to 22 carbon atoms, for example, butylamine ($C_4$), pentylamine ($C_5$), hexylamine ($C_6$), heptylamine ($C_7$), octylamine ($C_8$), nonylamine ($C_9$), decylamine ($C_{10}$), undecylamine ($C_{11}$), dodecylamine ($C_{12}$), tridecylamine ($C_{13}$), tetradecylamine ($C_{14}$), pentadecylamine ($C_{15}$), hexadecylamine ($C_{16}$), heptadecylamine ($C_{17}$), octadecylamine ($C_{18}$), nonadecylamine ($C_{19}$), eicosylamine ($C_{20}$), heneicosylamine ($C_{21}$) and docosylamine ($C_{22}$).

In one iteration the alkylamine is hexylamine. In another iteration the alkylamine is nonylamine. In a further iteration the alkylamine is dodecylamine. In still further iteration the alkylamine is pentadecylamine. In yet another iteration the alkylamine is octadecylamine.

In a further aspect the alkylamine can be a polystyreneamine having a molecular weight of from about 500 gm/mole to about 10,000 gm/mole.

In one aspect disclosed herein is a monolayer, comprising a plurality of alkylamine-gold nanoparticles, wherein the alkylamine is on the surface of the gold nanoparticle core and wherein the alkylamine is chosen from a $C_4$-$C_{22}$ linear alkylamine and wherein further the interparticle spacing between nanoparticles is from about 0.5 nm to about 5 nm.

Another aspect disclosed herein is a water/oil interface method for preparing the disclosed monolayers, comprising:

a) charging to a vessel having a target surface positioned at the bottom of the vessel an aqueous solution of gold nanoparticles;
b) depositing on top of the aqueous solution an organic layer comprising one or more alkylamines thereby forming an aqueous/organic layer interface;
c) adding one or more polarity adjusting agents to the organic layer thereby forming alkylamine-gold nanoparticles at the aqueous/organic interface; and
d) removing the aqueous layer thereby depositing the alkylamine-gold nanoparticles on the target surface.

A further aspect disclosed herein is a water/oil/air interface method for preparing the disclosed monolayers, comprising:

a) charging to a vessel a first organic solution of an amine;
b) injecting an aqueous colloid of gold nanoparticles below the surface of the organic solution in an amount sufficient to allow the colloid to protrude through the organic solution and form an organic solution/water and water/air interface; and
c) adding to the organic solution/water interface a second organic solution in sufficient amount to cause the gold nanoparticles to propagate to the water/air interface.

One embodiment of this aspect comprises:

a) charging to vessel a solution of a $C_{12}$-$C_{18}$ saturated or unsaturated linear alkyl amine in hexane;
b) injecting an aqueous colloid of gold nanoparticles having an average diameter of from about 1 nm to about 40 nm beneath the hexane solution in a sufficient amount that a water/air interface forms; and
c) adding ethanol to the hexane/water interface.

Another embodiment of this aspect comprises:

a) charging to vessel a solution of a $C_{12}$-$C_{18}$ saturated or unsaturated linear alkyl amine in and admixture of hexane and chloroform;
b) injecting an aqueous colloid of gold nanoparticles having an average diameter of from about 1 nm to about 40 nm beneath the hexane/chloroform solution in a sufficient amount that a water/air interface forms; and
c) adding ethanol to the hexane/water interface.

In a further embodiment the colloid of gold nanoparticles comprises a charge stabilizer. In one example, the charge stabilizer is citrate, for example, a) charging to vessel a first solution of a $C_{12}$-$C_{18}$ saturated or unsaturated linear alkyl amine in an organic solution, for example, an admixture of hexane and chloroform or a solution of hexane or a solution of chloroform;
b) injecting an aqueous colloid of gold nanoparticles containing a stabilizer, beneath the first solution in a sufficient amount that a water/air interface forms, wherein the gold nanoparticles have an average diameter of from about 1 nm to about 40 nm; and
c) adding a second solution of ethanol to the first solution/water interface.

Without wishing to be limited by theory this embodiment of this aspect of the disclosure can be summarized as follows. Initially, the aqueous gold nanoparticle colloid was electrostatically stabilized by negative citrate ions during synthesis. The addition of a second organic solution, for example, ethanol destabilizes aqueous gold nanoparticles and drives them to the water/oil interface, where alkyl ligands attach to the gold nanoparticle surface displacing the citrate ions. It has been shown that the gold nanoparticles at such an interface have a Janus structure, the top of which (facing the oil phase) is passivated by alkyl ligands, whereas the bottom face retains residual citrate ions. The gold nanoparticles then form island structures (FIG. 12(A) upper right) as they rapidly migrate from the water/oil interface to the water/air interface. At the water/air interface, the gold nanoparticles spontaneously rearrange to eliminate free volume along the film boundary. The whole process can take as little as 10 minutes.

Figure 12:
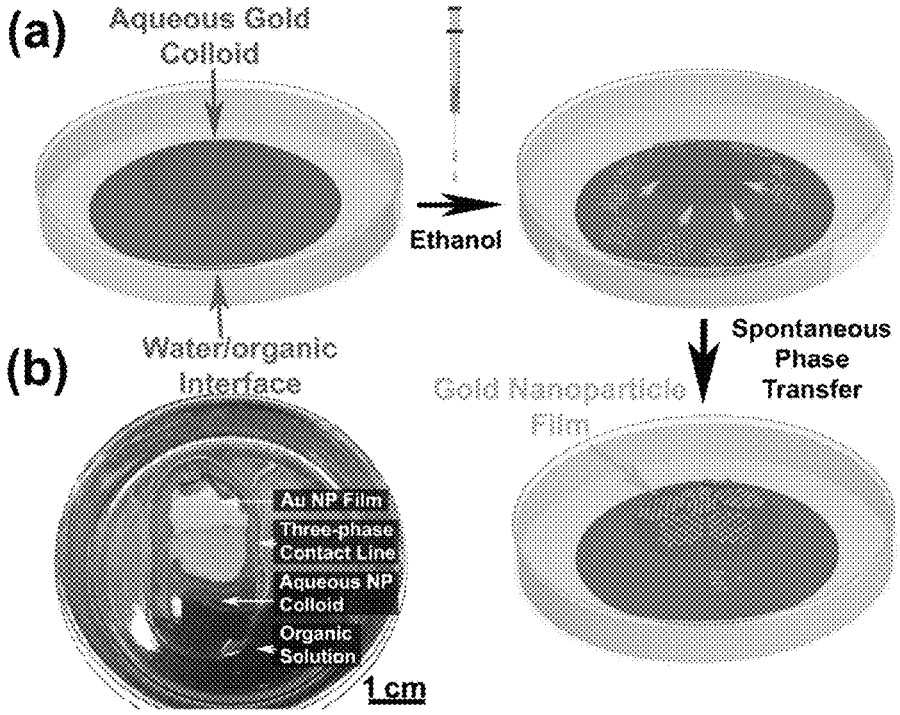
FIG. 12 depicts the oil/water/air interface process disclosed herein.
Figure 13A:
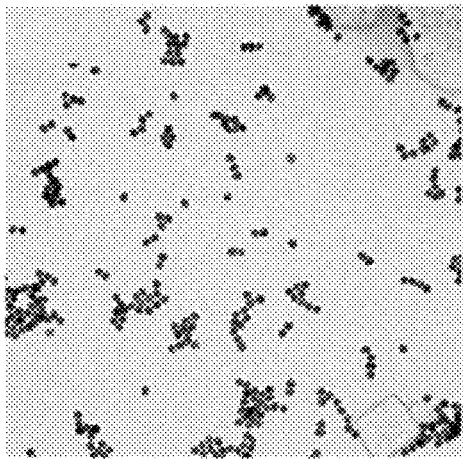
FIG. 13A is a TEM image of 6 nm gold nanoparticles prepared by the disclosed process.
Figure 13B:
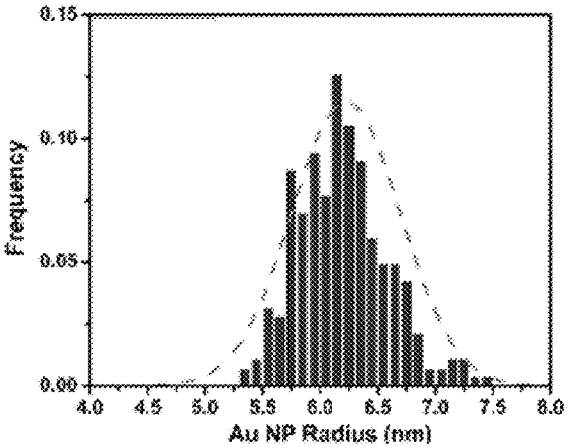
FIG. 13B is a histogram indicating the Gaussian distribution of the nanoparticles depicted in FIG. 13A.
Figure 14A:
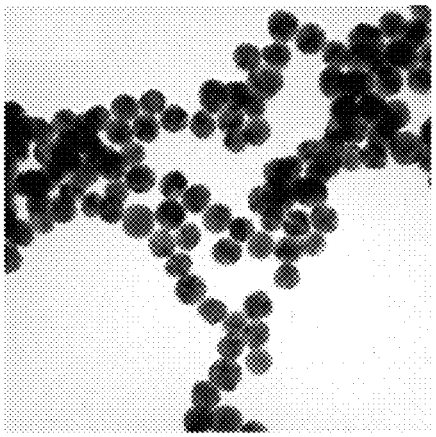
FIG. 14A is a TEM image of 18 nm gold nanoparticles prepared by the disclosed process.
Figure 14B:
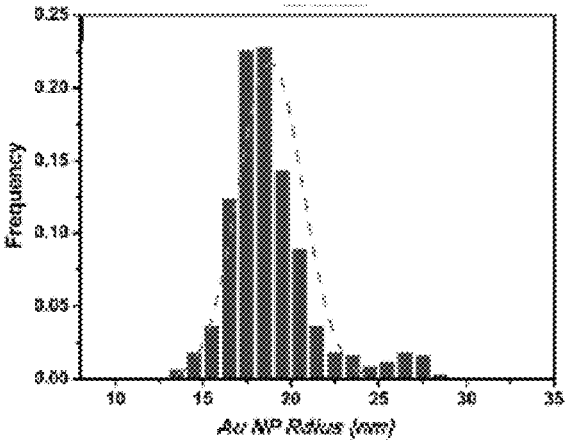
FIG. 14B is a histogram indicating the Gaussian distribution of the nanoparticles depicted in FIG. 14A.
Figure 15A:
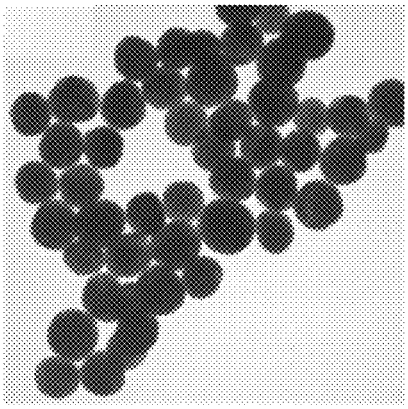
FIG. 15A is a TEM image of 28 nm gold nanoparticles prepared by the disclosed process.
Figure 15B:
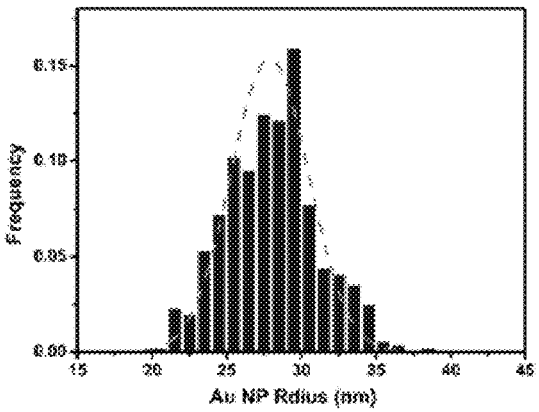
FIG. 15B is a histogram indicating the Gaussian distribution of the nanoparticles depicted in FIG. 15A.
Figure 16A:
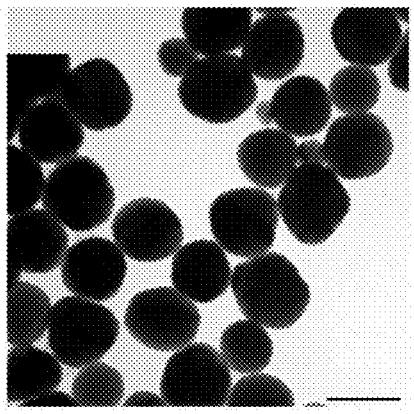
FIG. 16A is a TEM image of 45 nm gold nanoparticles prepared by the disclosed process.
Figure 16B:
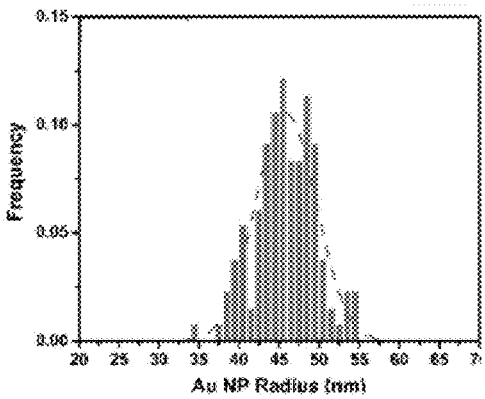
FIG. 16B is a histogram indicating the Gaussian distribution of the nanoparticles depicted in FIG. 16A.
Figure 17:
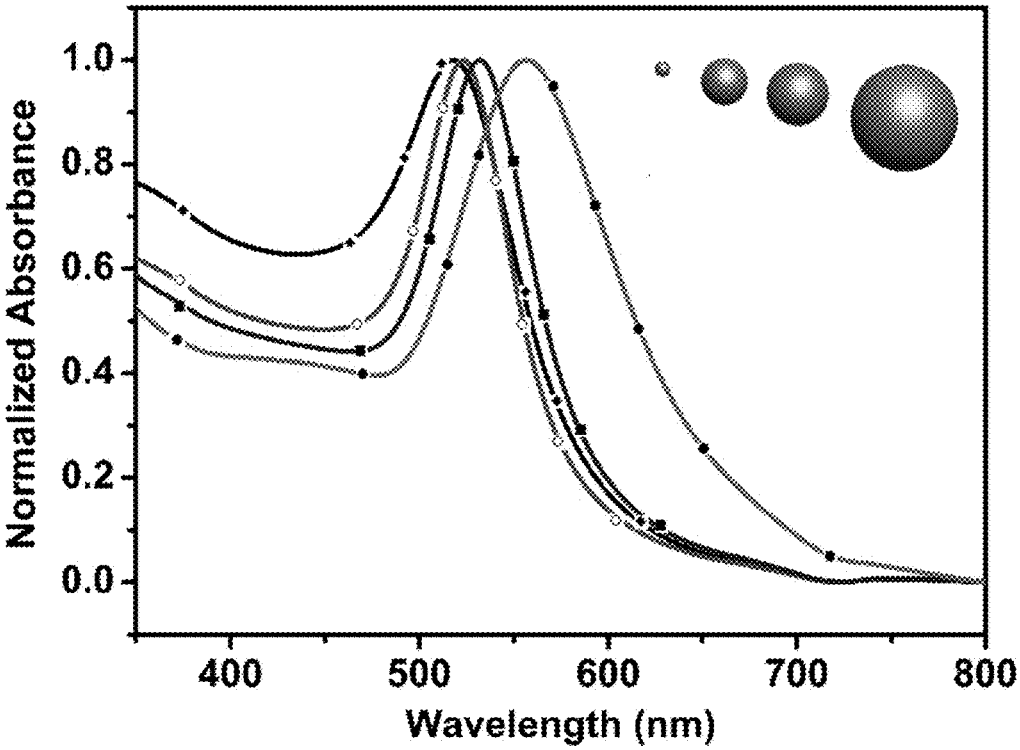
FIG. 17 represents the normalized UV-visible spectra of the aqueous nanoparticle colloids represented in FIGS. 13-16. The insert provides the relative sizes of the nanoparticles. The spectrum indicated by ♦ is the result of 6 nm nanoparticles, the spectrum indicated by ○ is the result of 18 nm nanoparticles, the spectrum indicated by ■ is the result of 28 nm nanoparticles, and the spectrum indicated by ● is the result of 45 nm nanoparticles.
Figure 18A:
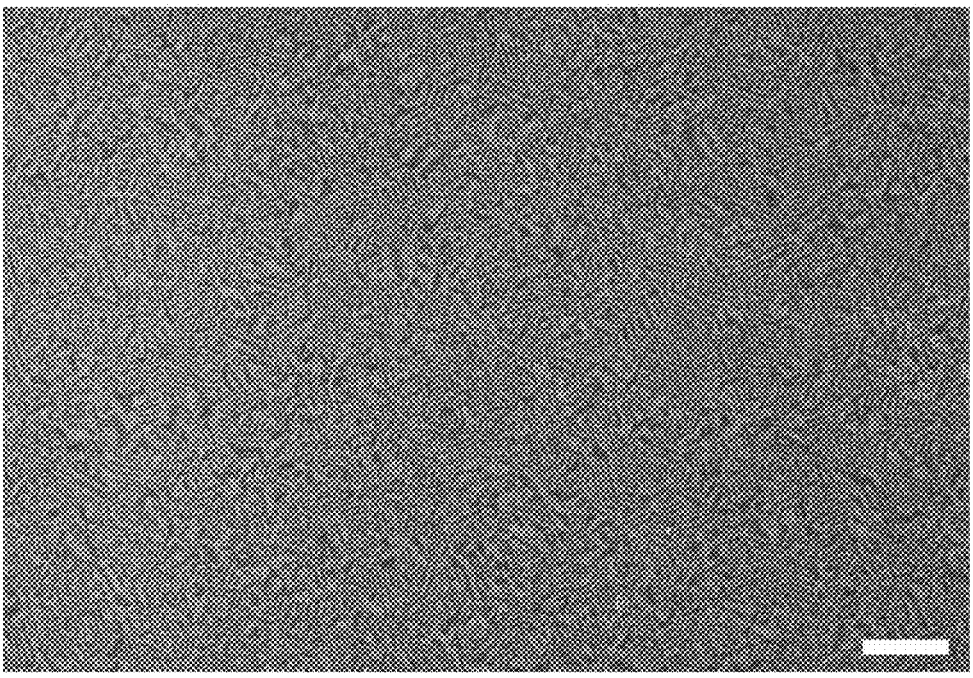
FIGS. 18A-B are SEM images of $C_{18}$ gold nanoparticles prepared by the disclosed air/water/oil three phase system. The scale bar for FIG. 18A is 1 μm whereas the scale bar for FIG. 18B is 100 nm.
Figure 18B:
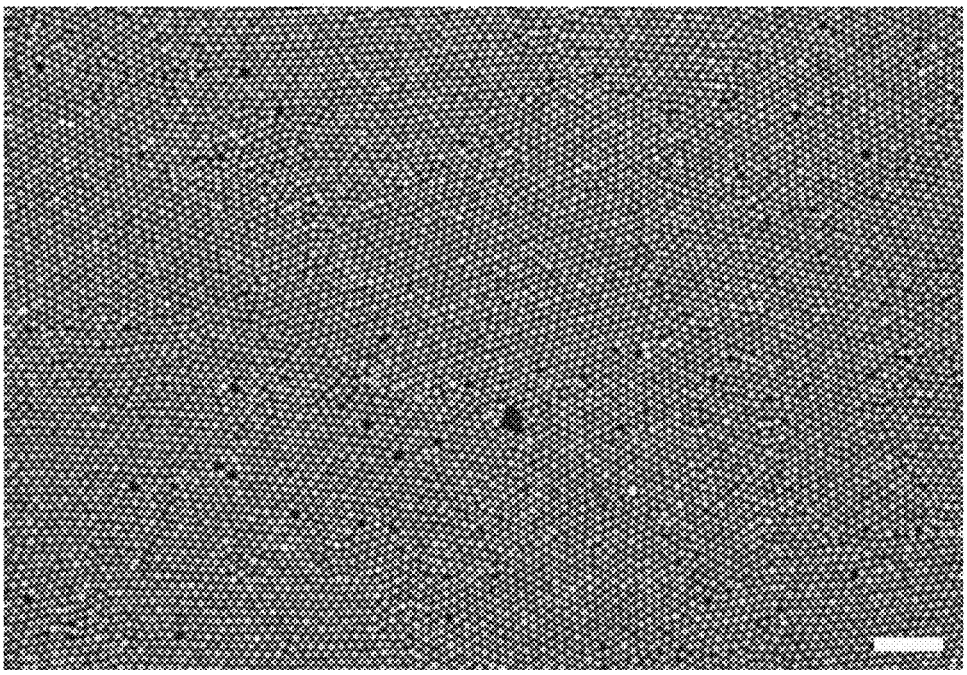
Figure 19A:
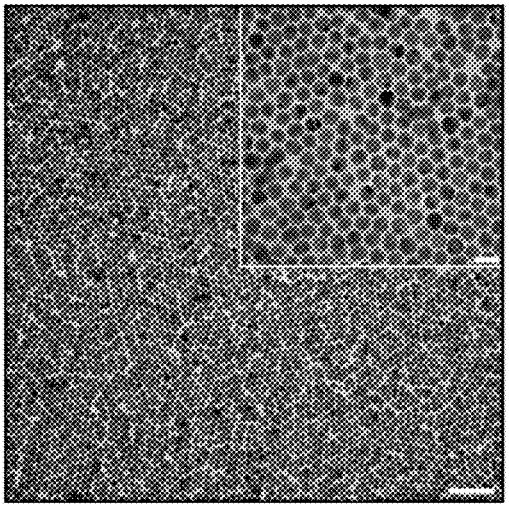
FIGS. 19A-E are TEM images of gold nanoparticles having various ligands.
Figure 19B:
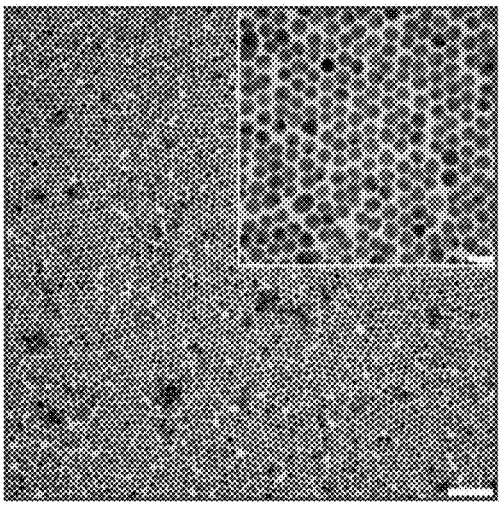
Figure 19C:
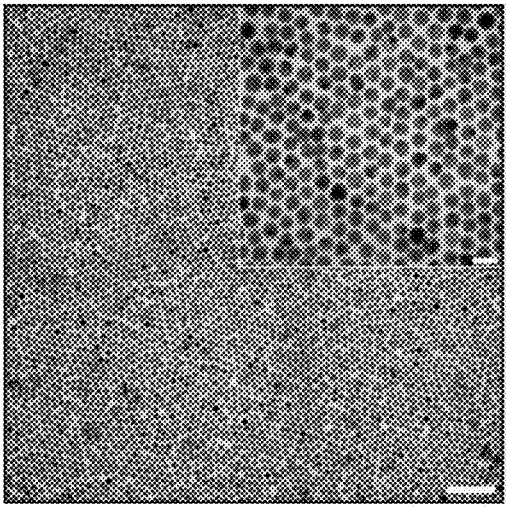
Figure 19D:
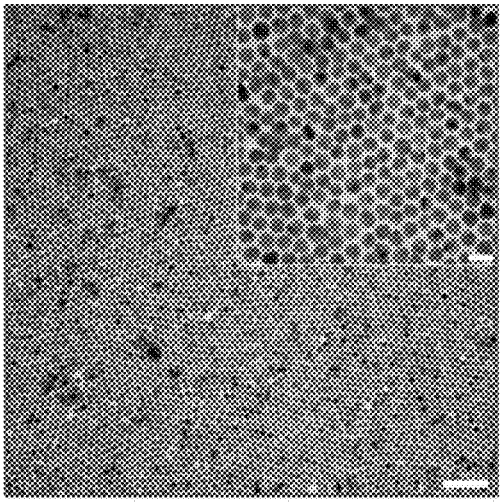
Figure 19E:
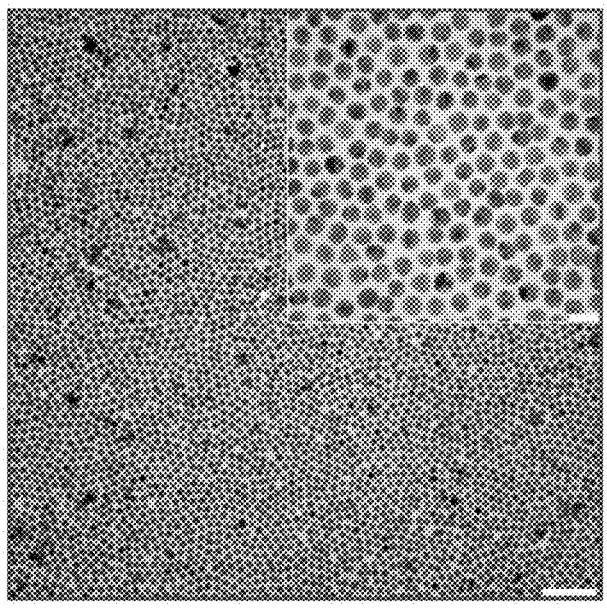
Figure 20:
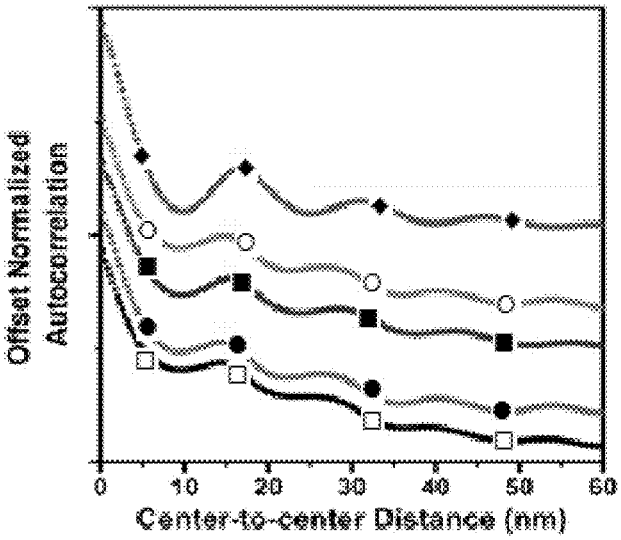
FIG. 20 is a plot of the normalized radial distribution of the films displayed in FIGS. 19A-E. The line with the symbol □ represents the monolayer wherein the ligand is $C_{12}$ linear alkyl amine, the line with the symbol ● represents the monolayer wherein the ligand is $C_{15}$ linear alkyl amine, the line with the symbol ■ represents the monolayer wherein the ligand is $C_{18}$ linear alkyl amine, the line with the symbol ○ represents the monolayer wherein the ligand is oleyl amine, and the line with the symbol ♦ represents the monolayer wherein the ligand is a 5000 g/mol polystyrene amine.
Figure 21:
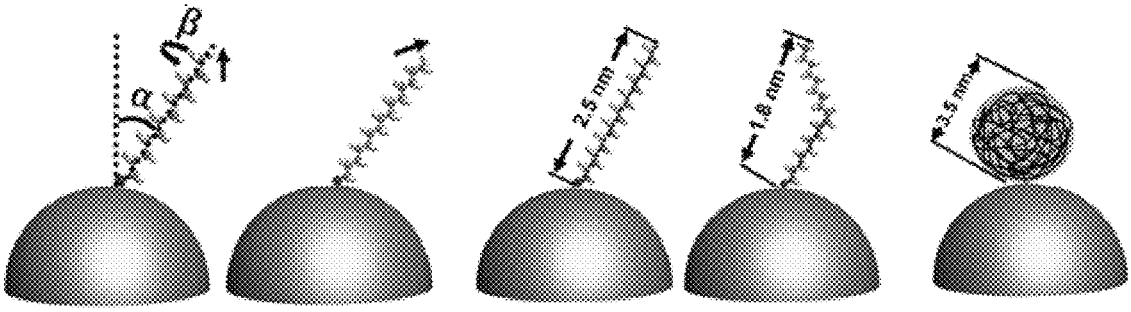
FIG. 21 is a pictorial representation of the nanoparticles described in FIGS. 19A-E and FIG. 20.
Figure 22A:
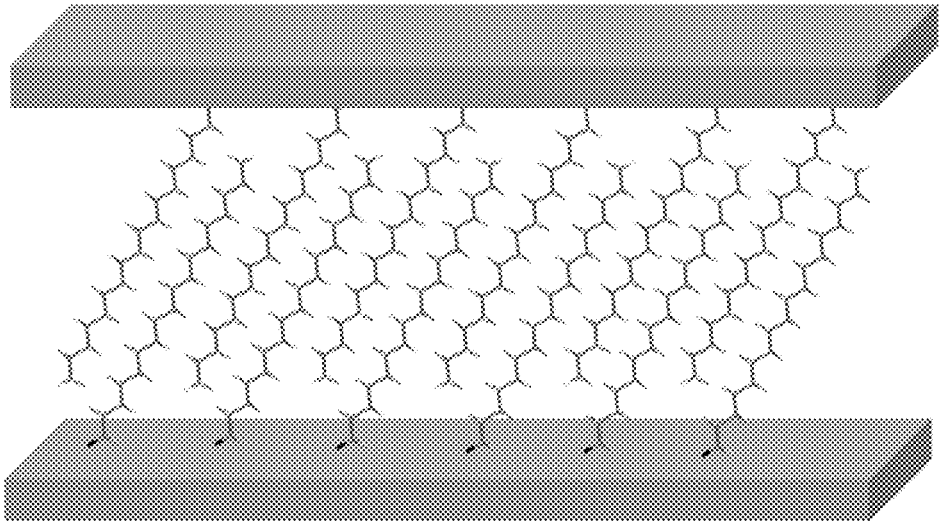
FIGS. 22A-C are pictorial representations showing the manner in which the selection of the ligand can affect the spacing between adjacent nanoparticles.
Figure 22B:
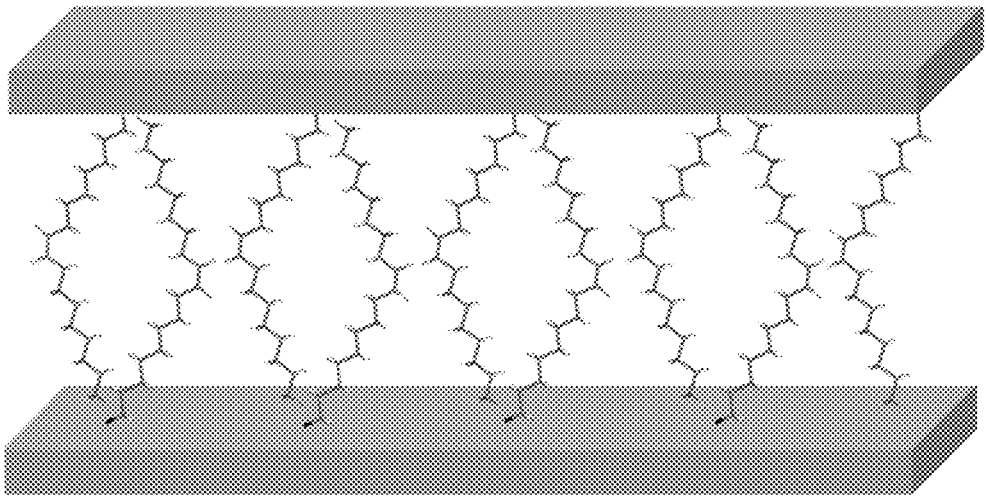
Figure 22C:
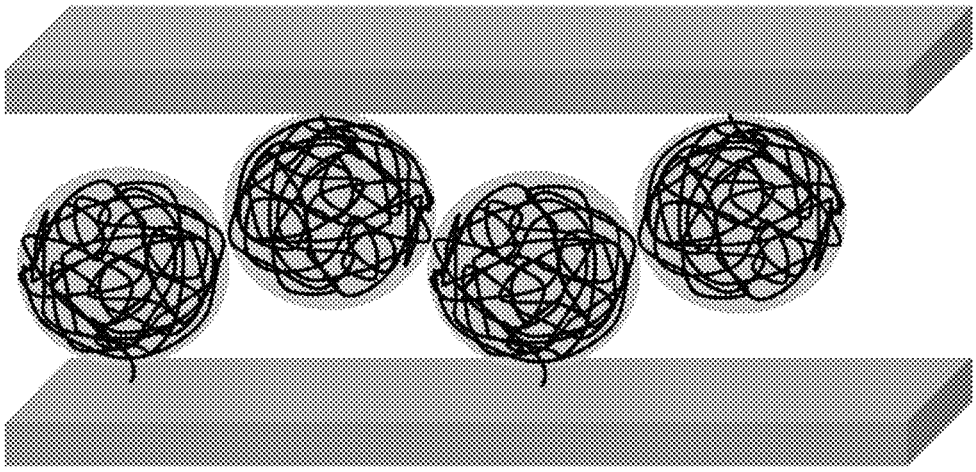
Figure 23:
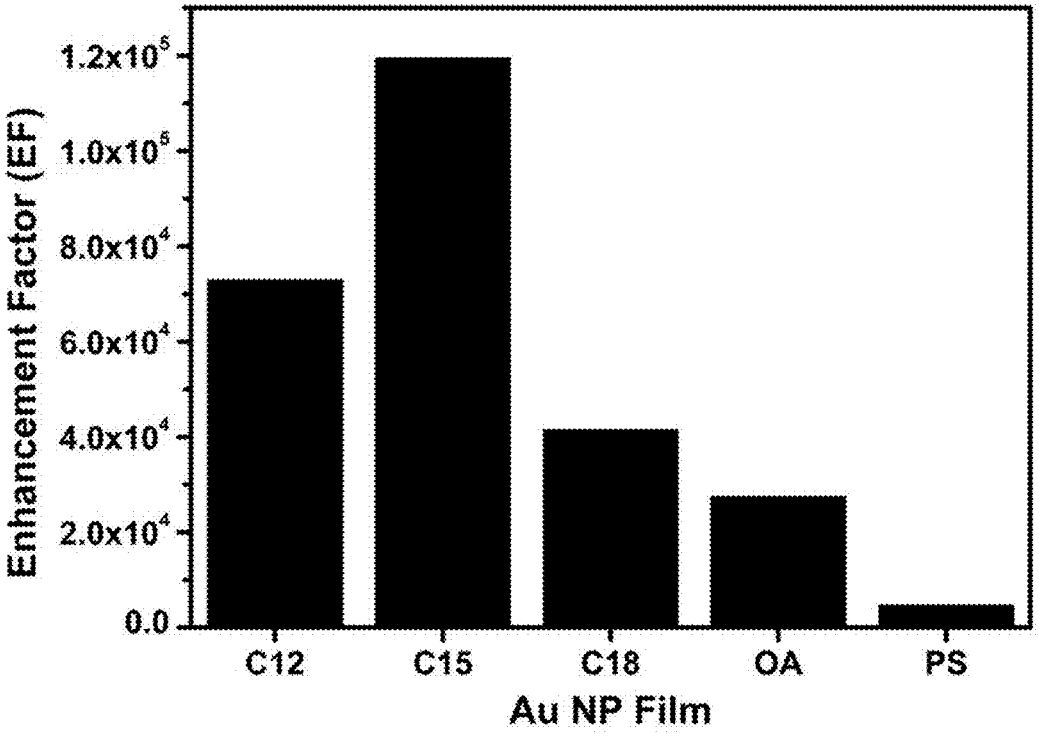
FIG. 23 is a histogram displaying the enhancement factor for various ligands when the oil/water/air process is used to form the gold nanoparticle monolayers.

Consequently, a gold nanoparticle film of a large area was gradually generated at the water/air interface (FIG. 12(A) lower right). The gold nanoparticle film fabricated in this way, as shown in FIG. 1(B), occupies a large area. Afterwards, the gold nanoparticle films were deposited on solid wafers using the method previously reported ((See Yang G et al. "Gold Nanoparticle Monolayers with Tunable Optical and Electrical Properties," *Langmuir* 32, 4022-4033 (2016)). The resultant gold nanoparticle monolayers have a gold sheen appearance in reflectance, whereas when viewed in transmittance, those films were blue.

Preparation

One aspect of the disclosed monolayers can be prepared by the following procedures.

Gold (III) chloride trihydrate ($HAuCl_4.3H_2O$, ≥99.9% trace metals basis), sodium citrate dihydrate ($HOC(COONa)(CH_2COONa)_2.2H_2O$ ≥99%), ethanol (ACS reagent, 99.5%), n-hexane (anhydrous, 95%), hexylamine ($CH_3(CH_2)_5NH_2$, 99%), nonylamine ($CH_3(CH_2)_8NH_2$, 98%), dodecylamine ($CH_3(CH_2)_{11}NH_2$, ≥99%), pentadecylamine ($CH_3(CH_2)_{14}NH_2$, 96%), and octadecylamine ($CH_3(CH_2)_{17}NH_2$, 97%) were purchased from Sigma-Aldrich and used as received. Deionized (DI) water (18.2 MΩ cm) was supplied by a Millipore water purification system. Gas-tight containers (10×10×5 $cm^3$, Snapware) were used for interfacial ligand exchange and monolayer self-assembly. For all experiments, glassware was thoroughly cleaned with Piranha solution at 60° C. Custom Teflon wells (with inner dimensions 5×2 $cm^2$ and depth of 1.5 cm) and Teflon coated magnetic stir bars (VWR) were cleaned using acetone followed by THF. All glassware, stir bars, and Teflon wells were rinsed with DI water and oven-dried overnight at 100° C. before use.

Preparation of Gold Nanoparticles

Citrate-stabilized gold nanoparticles were prepared using a modified Turkevich method. (See, Yang, G et al., "A convenient phase transfer protocol to functionalize gold nanoparticles with short alkylamine ligands," *Journal of Colloid and Interface Science,* 2015. 460: p. 164-172.) Aqueous solutions of $HAuCl_4$ (200 mL, 0.5 mM) and sodium citrate (10 mL, 38.8 mM) were brought to boiling separately. Then the latter was rapidly added to the former under vigorous stirring. A gradual visual color change from light purple to red was observed. The mixture was kept boiling for 20 minutes until the color remained unchanged. Full conversion of the Au (III) to gold nanoparticles is expected due to the large stoichiometric excess of sodium citrate, which acts as reducing agent. All samples used in this study were diluted to 75 vol % of the as-synthesized gold nanoparticle colloid with DI water.

General Method for the Preparation of Monolayers Via Oil/Water Process

A Teflon well containing two pieces of glass slides (18×18 $mm^2$) (Ted Pella) was placed in a gas-tight container. Other substrates (silicon wafers, copper grids) were attached to the glass slides using carbon tape. Five milliliters of aqueous gold-nanoparticle colloid was transferred to the Teflon well followed by 2 mL of an alkylamine/hexane solution. The two immiscible liquids, alkylamine hexane solution and aqueous gold colloid, formed an interface with alkylamine hexane layer on top. After capping the gas-tight container, 2 mL of 75 vol % ethanol in DI water was added via syringe at 0.5 mL/min (controlled by a peristaltic pump, Masterflex L/S). A golden sheen film formed at the hexane/water interface.

A syringe needle was inserted to the bottom of the Teflon well through a small port on the gas-tight lid. The subphase aqueous layer was removed through the syringe at 0.05 mL/min. The nanoparticle film and organic/aqueous interface descended at a rate of $5\times10^{-3}$ cm/min until the nanoparticle film deposited on the substrates. The remaining amine/hexane solution was also removed after film deposition. After deposition, the gas-tight lid was replaced with a lid comprising a 5×5 array of holes (with single hole diameter 0.2 mm and hole-to-hole distance 1 cm). This allowed residual water to slowly evaporate from the film over the course of 48 hours.

General Method for the Preparation of Monolayers Via Oil/Water/Air Process

Another aspect of the disclosed monolayers can be prepared by the following procedures.

An organic solution of amine (10.4 μM, 4.5 mL) was added to a petri dish (0=5.5 cm). Then, an aqueous gold colloid (1 mL) as described above was carefully injected to the bottom of the petri dish where it remained as a convex drop which protruded through the organic phase, i.e., it was exposed to air (as shown in FIG. 12(A)). Ethanol was then added dropwise (0.5 mL) to the water/hexane interface at a rate of about 0.1 mL/minute. Subsequently small gold nanoparticle islands of golden sheen appeared at the water/hexane interface (FIG. 12(B)). The islands then rapidly moved from the water/oil interface to the water/air interface to form a larger gold nanoparticle film (FIG. 12(C)). The time needed for the formation of the large-scale gold nanoparticle monolayers in this air/water/oil system was less than 10 minutes. After drying the surrounding organic solvent, the film was transferred to solid substrates for more in depth studies.

Both neat alkylamines and the corresponding alkylamine-gold nanoparticle films were characterized with Fourier transform infrared (FTIR) spectroscopy (Perkin Elmer, Frontier) with a diamond attenuated total reflection (ATR) accessory (Specac, Golden Gate). Wet alkylamine-gold nanoparticle films were transferred onto the diamond crystal with nitrogen flow immediately after being deposited on the glass slide. Spectra were collected in the region from 4000 to 650 cm' at room temperature after the film had fully dried (it took approximately 5 hours to dry each sample).

Transmission electron microscopy (TEM) micrographs were collected using JEOL JEM-2011 at an accelerating voltage of 200 kV. Each sample was deposited on a carbon coated copper grid (200 mesh, Ted Pella). Interparticle spacing of each alkylamine-gold nanoparticle film was analyzed with ImageJ software. [57] At least 500 gold nanoparticles on five different locations were analyzed for the alkylamine-gold nanoparticle films.

Grazing incidence small angle X-ray scattering (GISAXS) measurements were performed at beam line 8-ID-E, Advanced Photon Source at Argonne National Laboratory, with a monochromatic X-ray beam (at a photon energy of 7.35 keV). The gold nanoparticle monolayer on silicon wafers were tilted at an angle of 0.3°. Scattering was collected by an X-ray charge-coupled device (CCD) area detector at a distance of 1474 mm from the sample. The obtained data were reduced using the 'NIKA' package for Igor pro. A horizontal line cut was taken at a fixed $q_z$=0.5 $nm^{-1}$ in order to reduce the GISAXS data to a one-dimensional scattering profile. Other horizontal cuts at different $q_z$ values (from 0.3 $nm^{-1}$ to 0.8 $nm^{-1}$) were also obtained. The primary peak position remained unchanged for each of the alkylamine-gold nanoparticle monolayers that were prepared. FIG. 1 is a schematic illustration of the GISAXS setup. The incident beam impinges on the sample surface at a grazing angle, αi, and reflects off the sample surface at a set of in-plane angles, 2θf, and normal angles, αf. The scattering wave vector has two components, qy and qz on a 2-D detector placed in the y-z plane.

A UV-vis-NIR spectrophotometer (Agilent, Cary 5000) was used to optically analyze the 2D gold nanoparticle films deposited on glass slides. A glass slide containing a disclosed monolayer was mounted on a sample holder supplied with the instrument such that the incident beam was perpendicular to the sample. The measured wavelength was between 350 nm and 1200 nm. Before each UV-vis-NIR experiment, a background was collected from a blank glass slide. UV-vs-NIR spectra were collected from 3 to 5 locations on each film.

Figure 2A:
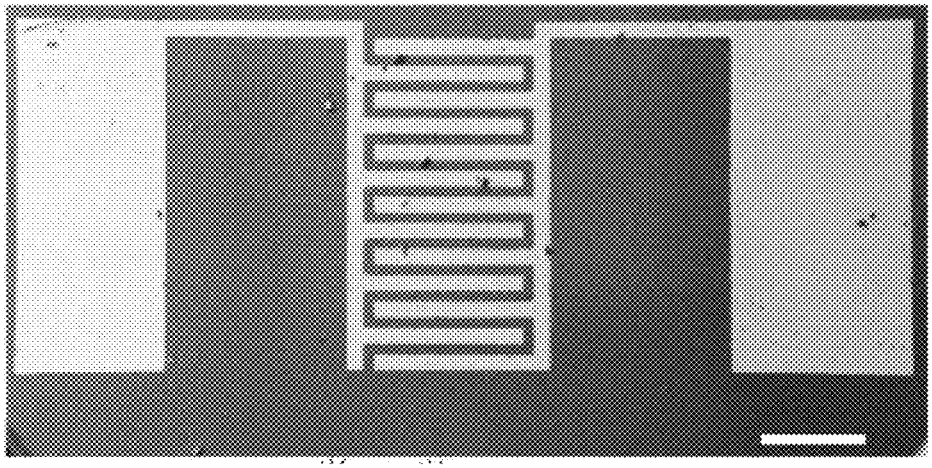
FIGS. 2A and 2B represent interdigitated electrodes (IDEs) used for electrical conductivity measurements.
Figure 2B:
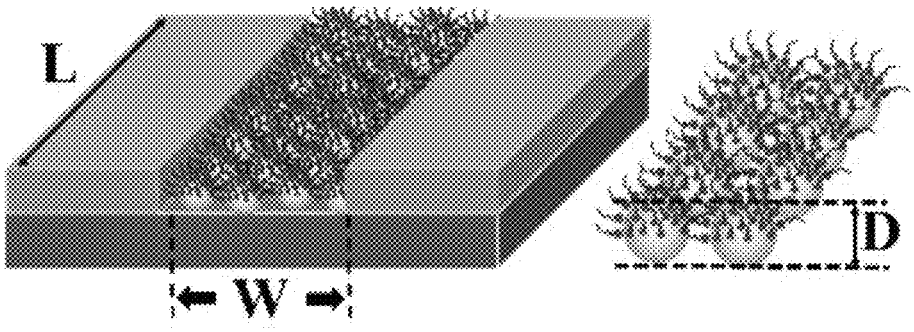

Interdigitated electrodes (IDEs) for electrical conductivity measurements are shown in FIG. 2A and FIG. 2B. FIG. 2A is a SEM image of an IDE while FIG. 2B is a schematic of the IDE geometry. The gap, W, between two IDE's is 50 μm and the total length, L, is 13650 μm. They consist of 6 pairs of gold fingers with a 50 μm gap (W) and total length of 13650 μm (L). They were fabricated using photolithography. A thin layer of light sensitive photoresist (AZ5214-E, AZ electronic material USA Co.) was spin-coated (5000 RPM for 30 s) on top of an $SiO_2$ wafer (250 nm $SiO_2$ on 500 μm Si, with resistivity on the order of $10^{14}$ Ω·cm). The photoresist-coated wafers were baked at 95° C. for 30 min. Then they were exposed to ultraviolet light (425 nm, Karl Suss MJB 3 mask aligner with a 350 W mercury lamp) for 8 seconds with a pre-defined mask. After developing the photoresist, all $SiO_2$ wafers were sent to a thermal evaporator (EDWARDS auto 306) to coat a 2 nm adhesive chromium layer followed by a 40 nm-gold layer in sequence. This was followed by a 2 minute-ultrasonication using acetone to remove photoresist. The disclosed alkylamine-gold nanoparticle monolayers were deposited on the IDEs using the disclosed procedure herein above. Resistance measurements were performed at 25° C. using a two-electrode configuration (Keithley 2401 SourceMeter). A custom Faraday cage composed of aluminum foil was connected to ground with an aluminum wire in order to prevent interference from stray electromagnetic fields. At least 3 monolayers were measured for each alkylamine ligand.

Figure 3:
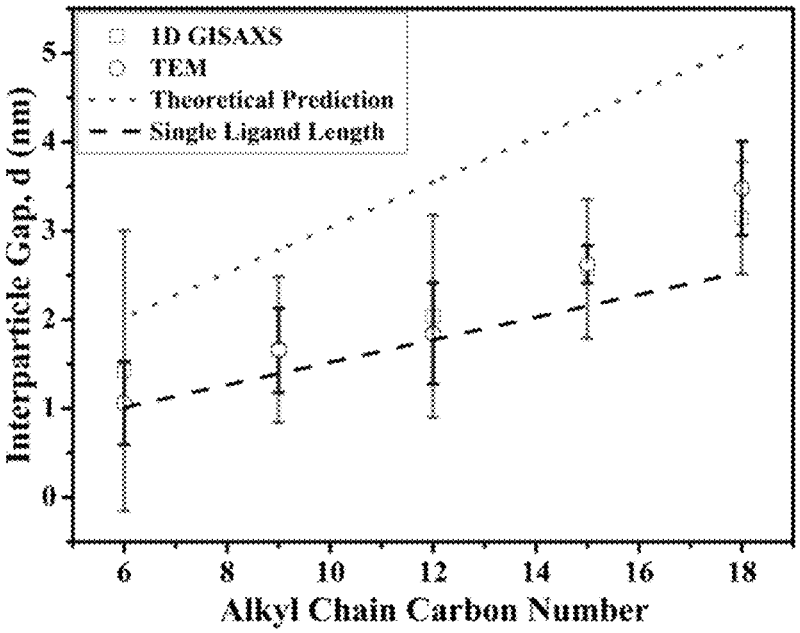
FIG. 3 depicts the interparticle spacing for alkylamine-gold nanoparticle monolayers versus alkylamine chain length. The observed spacing is represented by the dashed line and the theoretical spacing is represented by the dotted line.
Figure 4A:
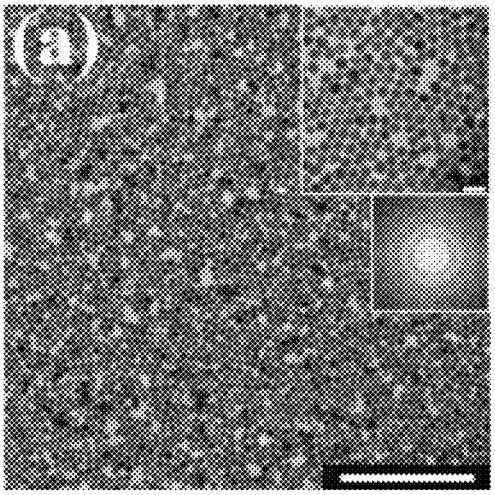
FIGS. 4A-4E are TEM micrographs of various alkylamine-gold nanoparticle monolayers.
Figure 4B:
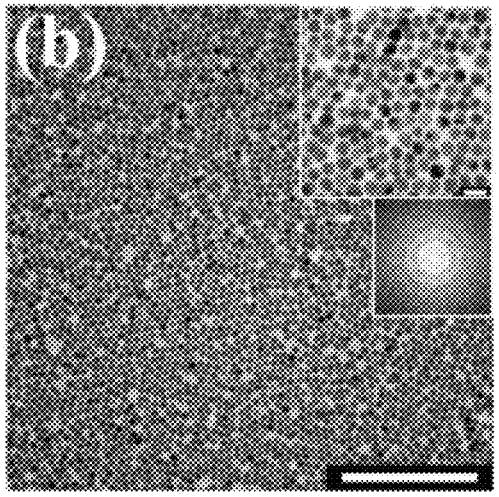
Figure 4C:
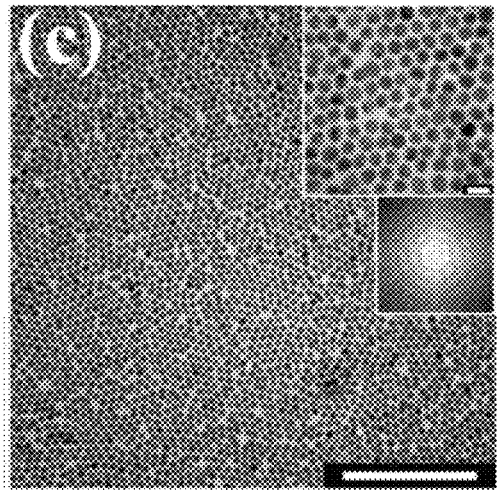
Figure 4D:
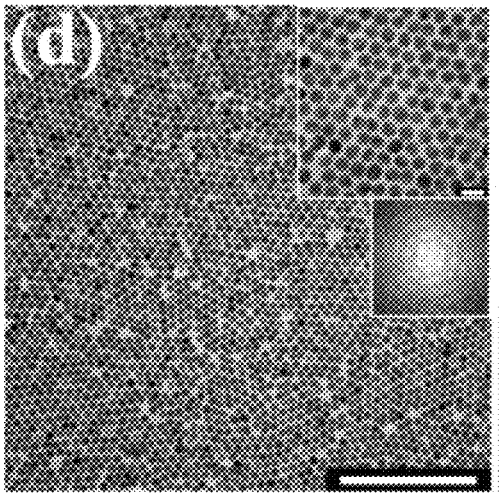
Figure 4E:
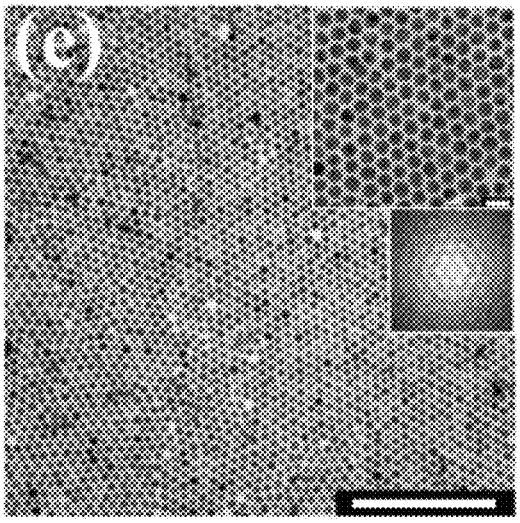

FIG. 3 depicts the interparticle spacing for alkylamine-gold nanoparticle monolayers versus the $C_6$-$C_{18}$ linear alkylamine surface modifier. The observed spacing is represented by the dashed black line and the theoretical spacing is represented by the dashed red line. The interparticle gap of each nanoparticle film is calculated from GISAXS (gray error bars) and TEM (blue arrow bars) as a function of the alkyl chain length and the corresponding theoretical prediction. The error bar in 1D GISAXS data is estimated by the standard deviation of the Gaussian fit performed on the 1D GISAXS primary peak, and the error bar in TEM data is from the standard deviation of the size distribution analysis.

Figure 7:
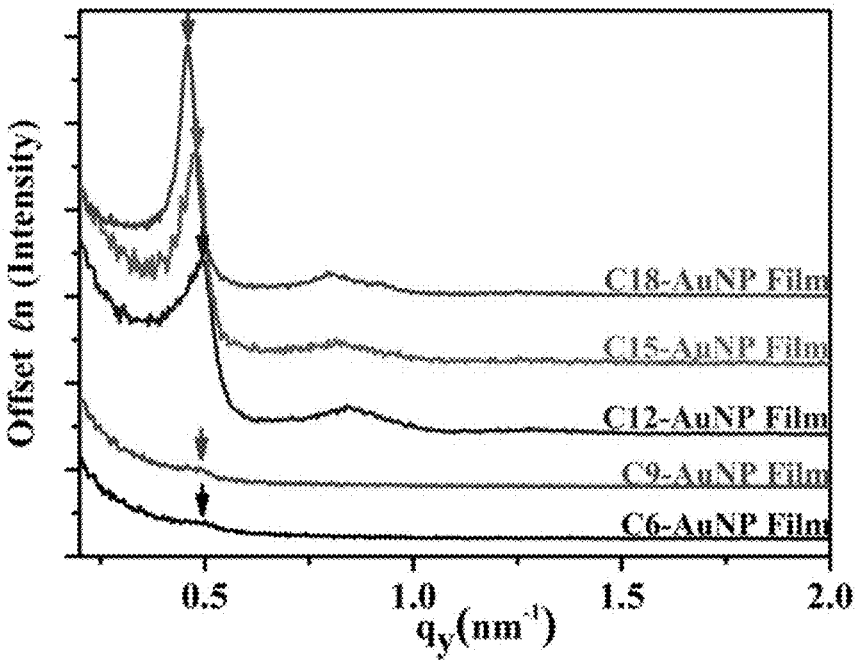
FIG. 7 represents the intensity offset for various lines along the $q_v$ axis depicted in FIG. 6, i.e., the primary peak indicates the distance between two neighboring (10) planes in each single layer of alkylamine-gold nanoparticle monolayer.
Figure 8:
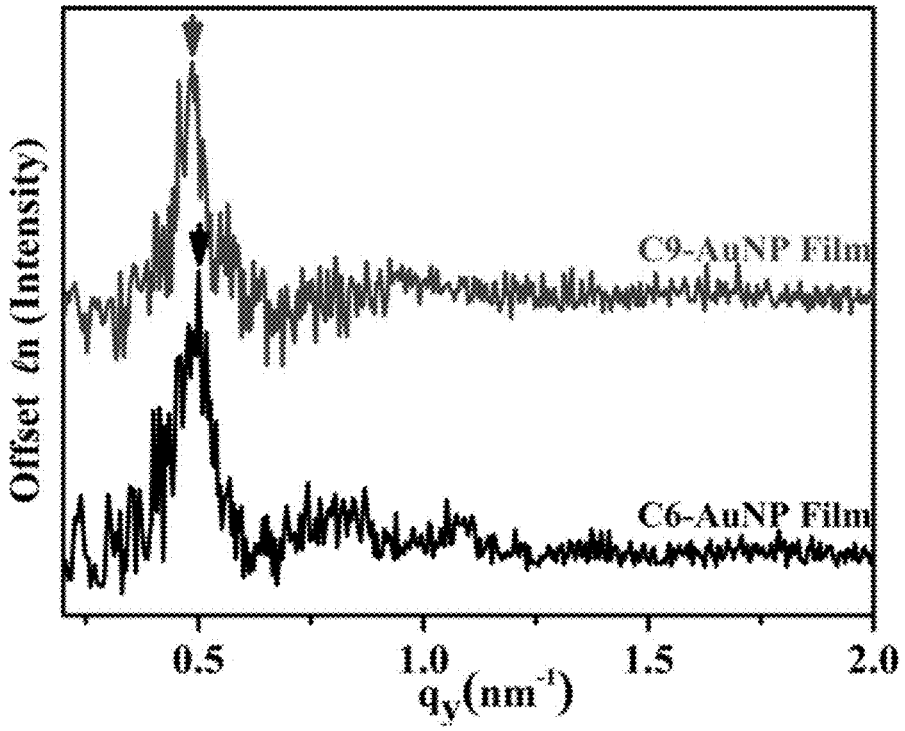
FIG. 8 represents the magnified 1-D GISAXS plots of a hexylamine-gold nanoparticle monolayer (black curve) and nonylamine-gold nanoparticle monolayer (red curve) for the examples shown in FIG. 7 after a background correction is applied.

The localized ordering of each film was characterized by TEM (FIGS. 4A-4E). By adjusting the ligand molar concentrations in hexane, a monolayer can be formed using any desired alkylamine ligand. The alkylamine molar concentrations for the exemplified monolayers are as follows: 1 mM for hexylamine, 0.1 mM for nonylamine, 0.01 mM for dodecylamine, 0.001 mM for pentadecylamine and 0.0002 mM for octadecylamine. The structural information provided by 2D GISAXS were reduced to a 1D plot through a horizontal line cut at qz=0.5 $nm^{-1}$. The 1D profiles of each film are presented in FIG. 7 and FIG. 8 as the ln (intensity) vs qy. The primary peak of each 1D scattering profile corresponds to the (10) plane of a 2D hexagonal lattice.

The electron transfer between metal nanoparticles is governed by the overlap of the electron wave functions of adjacent nanoparticles such that near field interactions can lead to classical coupling. Alternatively, electron density overlap can induce quantum mechanical coupling. As such, the optical and electronic properties of the disclosed monolayers are in part governed by the electron transfer to and from the metal core of the nanoparticles, i.e., gold particle to gold particle transfer. Therefore, the interparticle charge transfer can be manipulated by tuning the interparticle separation. As such, the rate and efficiency of this transfer can be controlled by modulating the distance between nanoparticle cores as depicted in FIG. 5 and FIG. 6.

Tunable Optical and Electronic Properties

Figure 5:
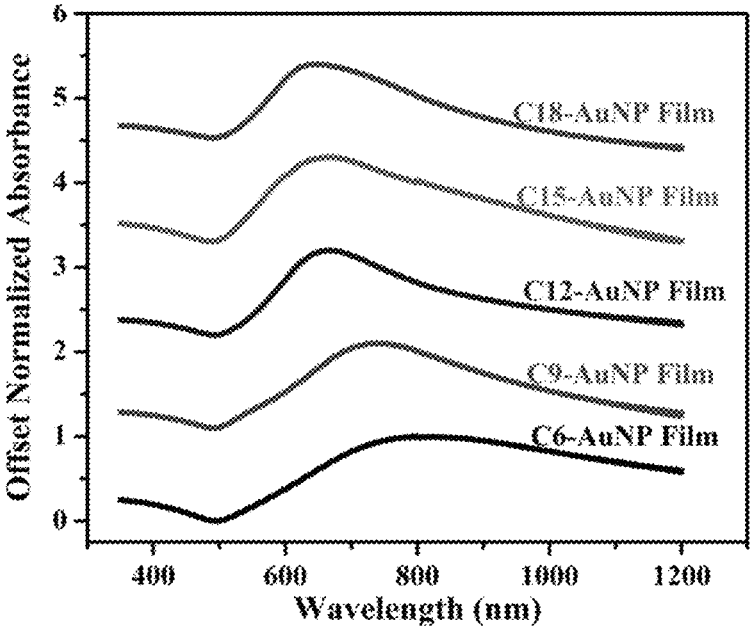
FIG. 5 shows the UV-visible-near infrared absorbance spectra for various disclosed alkylamine-gold nanoparticles as a function of alkyl chain length.
Figure 6:
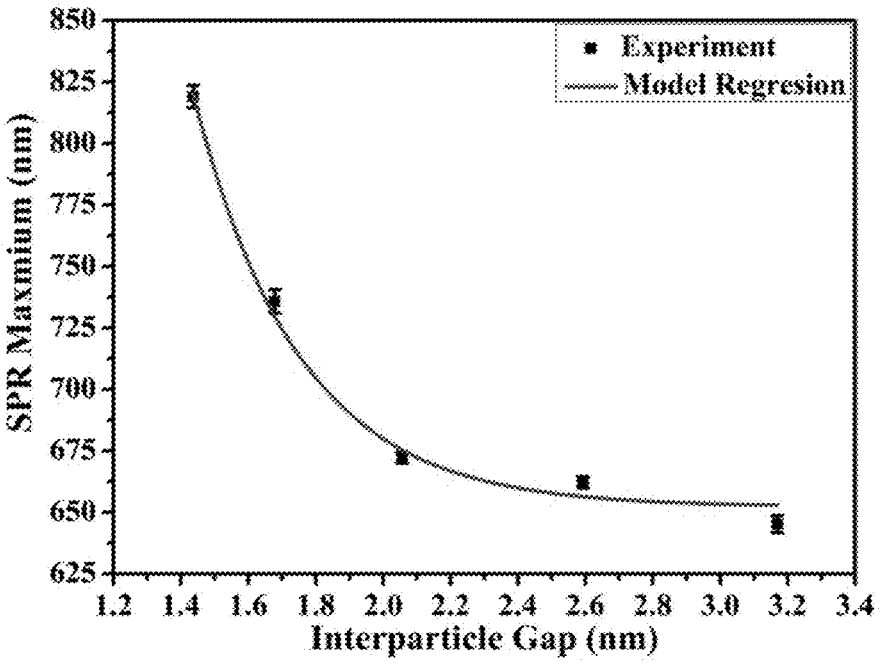
FIG. 6 shows the best fit curve for the observed Surface Plasma Resonance (SPR) versus the observed interparticle gap.

The disclosed nanoparticle monolayers have tunable optical properties, as depicted in FIG. 5, wherein the UV-visible-near infrared absorbance spectra collected from five representative alkylamine-gold nanoparticle monolayers shows a red-shift in maximum wavelength. The SPR maximum of these films gradually red-shifts from 819.0±4.5 nm for n-hexylamine-gold nanoparticles to 645±3.4 nm for n-octadecylamine-gold nanoparticles. The SPR maximum for these the examples depicted in FIG. 5 are dispersed in water and measured as 519 nm. (The plasma resonance for bulk gold in vacuum (at 273 K) is 219 nm.) The following exponential decay model was regressed to the SPR maxima, $\lambda_{max}$, versus interparticle gap, d, to obtain the best fit exponential decay model depicted in FIG. 6:

$$\lambda_{max}=\lambda_0+\lambda_A\exp(-/\beta d)$$

wherein $\lambda_0$ is 652.3 nm, $\lambda_A$ is $1.7\times10^4$ nm, and $\beta$ is 3.2 $nm^{-1}$.

The Surface Plasmon Frequency, $\omega_p$, of the disclosed monolayers was calculated then compared to the observed values. The SPR maximum can be calculated using the following relationship:

$$\lambda_{max} = \frac{c_0}{n\omega_p}.$$

The following Table I compares the calculated Surface Plasmon Resonance frequency and SPR maximum with experimental values.

TABLE I

| Sample | Calc. $\omega_p$, Hz | Calc. $\lambda_{max}$, nm | Exp. $\omega_p$, Hz | Exp. $\lambda_{max}$, nm |
|---|---|---|---|---|
| $C_6$-gold nanoparticle | $3.65\times10^{14}$ | 822 | $3.66\times10^{14}$ | 819 |
| $C_9$-gold nanoparticle | $4.11\times10^{14}$ | 731 | $4.07\times10^{14}$ | 736 |
| $C_{12}$-gold nanoparticle | $4.39\times10^{14}$ | 683 | $4.46\times10^{14}$ | 672 |
| $C_{15}$-gold nanoparticle | $4.59\times10^{14}$ | 654 | $4.53\times10^{14}$ | 662 |
| $C_{18}$-gold nanoparticle | $4.68\times10^{14}$ | 640 | $4.65\times10^{14}$ | 645 |

These data indicate the ability of the disclosed nanoparticle monolayers to have their emission spectra tuned by the formulator.

Figure 10:
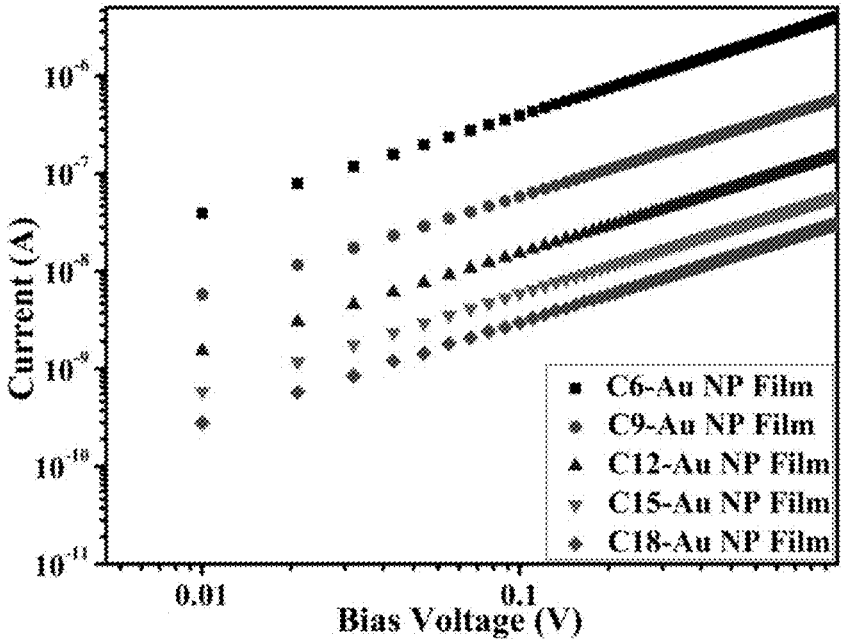
FIG. 10 is a graph of the linear current (A) versus voltage (V) response for various disclosed alkylamine-gold nanoparticle monolayers.
Figure 11:
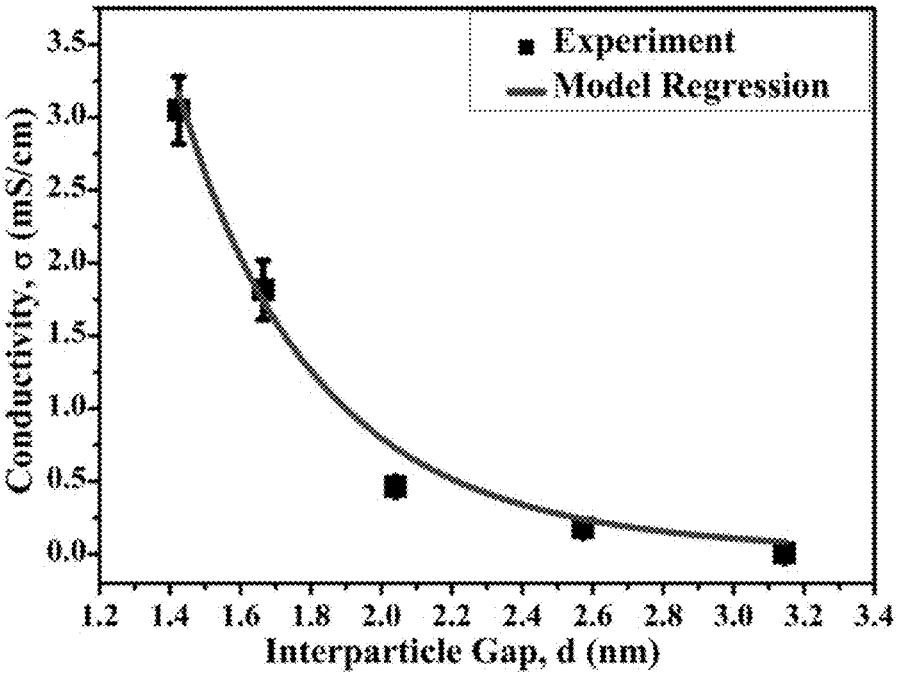
FIG. 11 demonstrates the dependence of the interparticle separation on the conductivity of various disclosed alkylamine-gold nanoparticle monolayers.

For nanoparticle assemblies, conduction occurs via electron tunneling between the metallic nanoparticles often via molecular junctions, which is strongly influenced by the interparticle spacing. The in-plane conductivity of a nanoparticle film is given by:

$$\sigma = \frac{W}{R\cdot D\cdot L}.$$

where $\sigma$ is the electrical conductivity and R the monolayer resistance. R was obtained from in-plane direct current (DC) measurements of the disclosed alkylamine-gold nanoparticle monolayers deposited on IDEs. As shown in FIG. 10, the in-plane current (I) versus voltage (V) of all five different alkylamine-gold nanoparticle monolayers at room temperature is linear (ohmic). R was taken from the inverse of the slope of the data shown in FIG. 10. As depicted in FIG. 11, the conductivity of the disclosed hexylamine-gold nanoparticle monolayer is on the order of $10^{-3}$ S/cm, about 8 orders of magnitude smaller than that of bulk gold ($4.43\times10_5$ S/cm at ambient temperature).

As shown herein, the disclosed alkylamine-gold nanoparticle monolayers exhibit a surface plasmon resonance (SPR) with a pronounced dependence on the alkyl chain length. In addition, the electrical conductivity of the films also exhibits a ligand-length dependent behavior. As such, the disclosed process affords precise control over 2D artificial nanoparticle crystal lattices comprising alkylamine ligands thereby providing a means for scaling up the manufacture of high-performance, 2D-superlattice-based photonic and electronic devices.

The disclosed monolayers have utility in many fields. One area of technology which is disclosed herein is Surface Enhanced Raman spectroscopy.

Raman spectroscopy (NRS) is a molecular vibrational technique that provides structural information at an atomic scale on the inorganic and organic compounds. It is useful to provide vibrational frequencies, band intensity, and many other vibrational parameters of species within materials such as battery electrolytes and reaction products adsorbed on electrode surfaces. Coupled with electrochemistry, it serves as a very powerful tool for the in situ study of the species and process occurring in galvanic cells. Despite the broad use of Raman in analyzing the species in lithium batteries, the standard approach to using Raman lacks sufficient resolution to probe the composition of the passive film on the electrode/electrolyte interface. In practice, this film is intrinsically thin (2-4 nm) and non-uniform. In addition, it may be light and heat sensitive so that decomposition may happen when it is exposed to the laser beam, especially when large laser energy is used.

In comparison to Normal Raman Spectroscopy, surface-enhanced Raman spectroscopy (SERS) offers orders of magnitude increase in Raman intensity, sufficient to allow low concentration molecule (even single molecule) detection using Raman. The interaction of the monochromatic light with metal surface results in the oscillation of the metal-free electrons with respect to the metal surface in resonance with the light electromagnetic field. This phenomenon is known as surface plasmon resonance. SERS results from the fact that, when an electromagnetic wave interacts with a metal surface, be it a rough plane metal, or metallic nanoparticle assembles, the localized surface plasmon on the surface may be exited, leading to the amplification of the electromagnetic fields near the surface. So far, the chemical component and the surface structure of the interfacial passive film in lithium batteries have been studied with those free electron metals that support SERS (i.e., silver, gold, and copper). One fundamental requirement for SERS is that the substrate supports surface plamon resonance. A promising category of substrates is the nanometer-scaled patterns with well-controlled ordering, which simplifies quantitative use of Raman spectroscopy. A typical example of such a substrate is noble metal nanoparticle arrays of narrow-size-distributed constituent particles with nanometer scale particle separation.

In order to quantitatively evaluate the Raman enhancement performance of various substrate, the metal surface electromagnetic (EM) enhancement factor (EF) is defined as $$EF = \left(\frac{E}{E_0}\right)^4$$

where E is the EM field intensity of the enhanced Raman signal, and $E_0$ is the EM field intensity of the normal Raman signal.

The disclosed monolayers were used to identify the amount of rhodamine 6G (R6G) (dye content ~95%) present in a sample. Using a disclosed monolayer, the lowest amount of detectable rhodamine 6G was approximately 1 nM.

The formulator can therefore us the disclosed monolayers to establish calibration curves for various molecules which are in need of detection. For example, using R6G-ethanol solutions having known concentration as standards, the integration of characterized Raman peaks of R6G (e.g. C-C-C ring in-plane bending) can be calibrated to the R6G concentrations. This allows quantitative measurement of the concentration of the compound chosen for detection.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. A nanoparticle monolayer having tunable optical and electrical properties, comprising alkylamine-gold nanoparticles having an interparticle spacing from about 0.5 nm to about 5 nm.

2. The monolayer according to claim 1, wherein the alkylamine is chosen from $C_6$-$C_{18}$ linear or branched, saturated or unsaturated alkylamines.

3. The monolayer according to claim 1, wherein the alkylamine is a polystyrene amine.

4. The monolayer according to claim 1, wherein the alkylamine-gold nanoparticle monolayer has an interparticle spacing of from about 0.5 nm to about 4 nm.

5. The monolayer according to claim 1, wherein the alkylamine-gold nanoparticle monolayer has an interparticle spacing of from about 1 nm to about 4 nm.

6. The monolayer according to claim 1, wherein the alkylamine-gold nanoparticle monolayer has an interparticle spacing of from about 1 nm to about 3 nm.

7. The monolayer according to claim 1, wherein the gold nanoparticles have an average diameter of from about 1 nm to about 100 nm.

8. The monolayer according to claim 1, wherein the gold nanoparticles have an average diameter of from about 5 nm to about 40 nm.

9. A method for preparing an alkylamine-gold nanoparticle monolayer, comprising:

a) charging to a vessel a first organic solution of an alkylamine;

b) injecting an aqueous colloid of gold nanoparticles below the surface of the organic solution in an amount sufficient to allow the colloid to protrude through the organic solution and form an organic solution/water and water/air interface; and c) adding to the organic solution/water interface a second organic solution in sufficient amount to cause the gold nanoparticles to propagate to the water/air interface.

10. The method according to claim 9, wherein the alkylamine is chosen from $C_6$-$C_{18}$ linear or branched, saturated or unsaturated alkylamines.

11. The method according to claim 9, wherein the alkylamine is a polystyrene amine.

12. The method according to claim 9, wherein the alkylamine-gold nanoparticle monolayer has an interparticle spacing of from about 0.5 nm to about 5 nm.

13. The method according to claim 9, wherein the alkylamine-gold nanoparticle monolayer has an interparticle spacing of from about 1 nm to about 3 nm.

14. The method according to claim 9, wherein the alkylamine is dodecylamine.

15. The method according to claim 9, wherein the alkylamine is pentadecylamine.

16. The method according to claim 9, wherein the alkylamine is octadecylamine.

17. The method according to claim 9, wherein the alkylamine is oleylamine.

18. The method according to claim 9, wherein the aqueous colloid further comprises a charge stabilizer.

19. The method according to claim 9, wherein the first organic solution contains hexane, chloroform or mixtures thereof.

20. The method according to claim 9, wherein the second organic solution is ethanol.

* * * * *